United States Patent [19]

Lüdenbach

[11] 4,261,524

[45] Apr. 14, 1981

[54] ROLLER BLIND BOX

[75] Inventor: Günter Lüdenbach, Overath, Fed. Rep. of Germany

[73] Assignee: Dyna-Plastik Werke GmbH, Gladbach, Fed. Rep. of Germany

[21] Appl. No.: 139,404

[22] Filed: Apr. 10, 1980

Related U.S. Application Data

[63] Continuation of Ser. No. 971,639, Dec. 20, 1978, abandoned.

[30] Foreign Application Priority Data

May 16, 1978 [DE] Fed. Rep. of Germany ..... 2821373

[51] Int. Cl.[3] ..... B65H 75/02

[52] U.S. Cl. ..... 242/55; 160/26

[58] Field of Search ..... 242/55, 71.1, 67.1; 160/26, 133

[56] References Cited

U.S. PATENT DOCUMENTS

| | | | |
|---|---|---|---|
| 3,089,540 | 5/1963 | Schwartz | 160/26 X |
| 3,163,204 | 12/1964 | Golde | 160/26 |
| 3,208,682 | 9/1965 | Pastor | 242/71.1 X |
| 3,346,210 | 10/1967 | Carstensen | 242/71.1 |
| 3,842,890 | 10/1974 | Kramer | 160/26 |

FOREIGN PATENT DOCUMENTS

| | | | |
|---|---|---|---|
| 2601663 | 7/1977 | Fed. Rep. of Germany | 160/26 |

*Primary Examiner*—Edward J. McCarthy
*Attorney, Agent, or Firm*—Browdy and Niemark

[57] ABSTRACT

The invention comprises a roller blind box including a walling surrounding the rolled up roller blind assembly, a passage slit for the roller blind assembly extending throughout the entire length of the walling, two lateral face walls a roller blind shaft supported in the two face walls as well as a gearing for driving the roller blind shaft, wherein the walling surrounding the roller blind assembly has the form of a tube of a circular cross-section.

9 Claims, 1 Drawing Figure

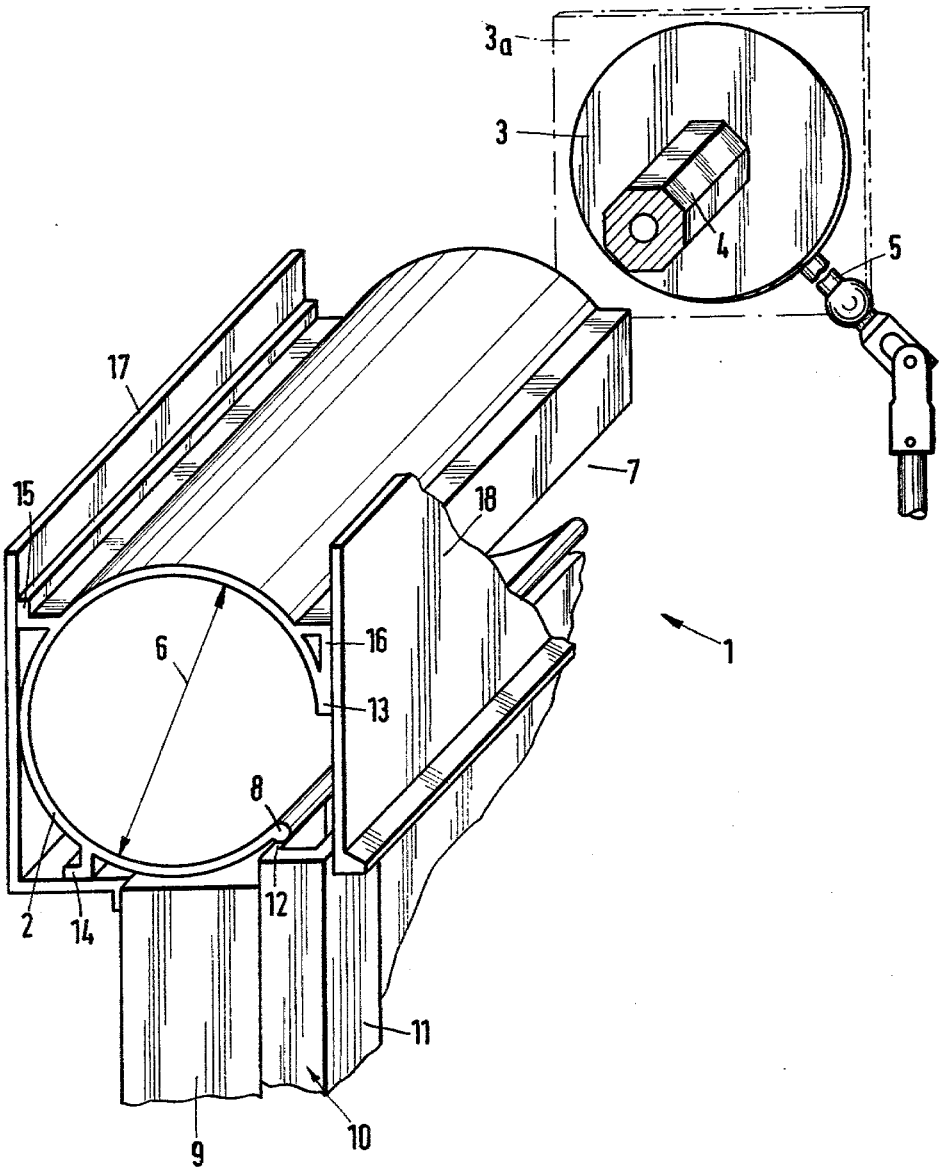
3a
3
4
5
17
7
15
18
1
6
16
13
8
2
14
12
11
9
10

ROLLER BLIND BOX

This is a continuation, of application Ser. No. 971,639 filed Dec. 20, 1978, abandoned.

This invention relates to a roller blind box including a walling surrounding the rolled up roller blind assembly, a passage slit for the roller blind assembly extending throughout the entire length of the walling, two lateral face walls, a roller blind shaft supported in the two face walls as well as a gearing for driving the roller blind shaft.

In conventional roller blind boxes of the type specified, the walling surrounding the rolled up roller blind assembly comprises four side walls combined into a rectangular box, one of the side walls having the passage slit for the roller blind assembly and another one having an access flap for performing assembly or repair operations. Such a conventional roller blind box is not able to be sealed or is able to be sealed only with difficulties, so that from externally dust and dirt are able to pass through the box into the spaces therebehind. Furthermore, this conventional box offers only an insufficient sound muffling and heat insulation effect.

An object of this invention is to provide a roller blind box which affords a good sealing relative to dirt and dust particles and offers a better sound muffling and heat insulation effect.

In the tubular roller blind box according to the invention, the space surrounding the rolled up roller blind assembly with the exception of the passage slit is completely and sealingly enclosed so that the roller blind box in the built-in condition represents a structural part tightly sealing the interior to the outside.

In addition thereto, the roller blind box according to the invention is easier to produce, to handle and to assemble or to disassemble. The walling surrounding the receiving space for the roller blind assembly may be produced in an extrusion process of plastic material, preferably hard PVC, a simple regenerate also being employable. Alo, it is possible to produce the tubular walling of foamed material. Furthermore, it is possible by virtue of the principle according to the invention to ready assemble the complete roller blind box unit by the manufacturer so that the finished roller blind box unit inclusive surrounding walling, lateral face walls, gearing, shaft and roller blind assembly may be marketed. Dispatching is completely unproblematic, since the tubular walling firmly encloses the entire unit and defines an integral part easy to handle. The unit delivered in this form to the construction site is easy to assemble, because it merely must be attached to the masonry by means of suitable fastener elements such as prefabricated brackets, by bolting or by grommeting. At the same time, the advantage is obtained that the unit with an according selection of the lateral face walls is insertible left-hand as well as right-hand.

Preferably, the internal diameter of the tubular walling is equal to the external diameter of the roller blind assembly rolled up into a round roll. In conventional roller blind boxes, upon rolling up of the roller blind assembly, an oval is obtained so that in the built-in condition a space must be made available for this oval which corresponds to the maximum diameter of the oval. With the measure according to the invention, it is possible, however, to roll up the roller blind assembly directedly into a very close, circular roll, the roll thereby being given its minimum possible dimensions.

For the same roller blind length thus when using the principle of this invention a low structural height can be maintained which is confined by the tubular walling and thus is predetermined for building-in. When the building-in dimensions at the brick-work are very closely tolerated, the roller blind box according to the invention can even be built-in in instances where conventional roller blind boxes for the same roller blind length do not fit into the space any more between the top side of the window frame and the masonry opening.

In order to insure that the roll closely rolled up in the circular tube and engaging the internal wall of the tube is able to also be conveniently rolled off without any difficulties, preferably a gearing acting bilaterally is provided by means of which the roller blind assembly is urged out of the circular tube for closing the roller blind.

The tube defining the walling may have retaining flanges or moldings at its external perimeter for the attachment of covering plates so that the circular tube may be lined inwardly and outwardly without any problems. For circular tubes which are to be produced in an extrusion process such retaining flanges are preferably formed continuously, i.e. extend throughout the entire length of the circular tube. These retaining flanges or moldings may also be formed in such a way that they may be used for the attachment of additional sound-muffling and heat-insulating plates and/or also for inner and outer linings to be made available at the building site.

When the roller blind box is to be used for extensive roller blind widths and the circular tube provided for the receiving space for the roller blind assembly consists of light material, it may be advantageous according to the invention for the circular tube to be reinforced. To this end, the circular tube may be provided with moldings having receiving openings for the insertion of reinforcement sections.

The invention is explained in closer detail by way of example in the drawing and described hereinafter in detail in referring to the drawing.

In the drawing, an embodiment of a roller blind box, partially in section, has been illustrated in an exploded view.

According to the drawing, the roller blind box 1 includes a circular tube 2 for receiving a rolled up roller blind assembly not illustrated in the drawing, two lateral face walls 3 of which only one has been illustrated in the drawing for the sake of clearness, a roller blind shaft 4 supported in the two face walls 3 as well as a gearing 5 acting bidirectionally for driving the roller blind shaft 4.

The circular tube 2 serving to receive the rolled up roller blind assembly and comprisable of extruded plastic material cut to length has an internal diameter 6 which is equal to the external diameter of the roller blind assembly rolled up closely into a circular roll. As a passage for the roller blind assembly, the circular tube 2 is provided with a slit 7 extending throughout the entire length thereof, the lower confining edge of which is provided with a circular bead 8.

In the built-in condition of the roller blind box 1, it rests on the upper side of a window frame 9, this projecting laterally beyond the respective face ends of the roller blind box 1 by the thickness of the respective face wall 3. The position of the slit 7 of the built-in roller blind box is aligned relative to a lateral roller blind guide 10 which extends parallel to the window frame 9 at both roller blind sides. The roller blind guide 10 has an essentially U-shaped cross-section the limbs 11 and 12 of which enclose the edge of the roller blind and guide it. The passage slit 7 of the circular tube 2 is aligned relative to the roller blind guide in such a way that the bead 8 defining the lower slit confinement generally is disposed above the U-limb 12 engaging the window frame 9, while the upper slit edge 13 generally is aligned relative to the external U-limb 11 of the roller blind guide.

At its external perimeter, the circular tube is provided with retaining flanges 14, 15 and 16 extending throughout the entire tube length, which flanges are integrally joined to the tube when the round tube 2 is extruded. The retaining flanges 14 and 15 arranged at the one side serve to attach an angular covering part 17, and the retaining flange 16 provided at the opposite side serves to attach an external lining plate 18.

The two face walls 3 serve to laterally close the circular tube 2, said walls being placed upon the internal cross-section of the circular tube 2 and being secured thereto. The face walls 3 at the same time serve to support the shaft 4. The side part 3 illustrated in full lines in the drawing and formed circularly which is conformed in its circumference to the diameter of the circular tube 2 at the same time serves to provide a retaining means for the gearing 5 acting bidirectionally of which merely the drive shaft has been illustrated in the drawing. Instead of a circularly formed side part 3, of course also a side part having corners may be provided as illustrated at 3*a* which has been illustrated in phantom in the drawing and the outer outlines of which are not permitted to project beyond the covering plates 17 and 18. This side part 3*a* formed with corners may have the same shape as the side part according to the German Utility Pat. No. 78 06 067 which is very variable regarding its building-in capabilites. Since the circular tube 2 is insertable both right-hand and left-hand, various building-in possibilities for the roller blind box may be realized.

In an alternative embodiment of a roller blind box not illustrated in the drawing which is provided with an elongate circular tube 2, the retaining flanges 14, 15 and 16 are formed as moldings which are provided with receiving openings for the insertion of reinforcement sections.

All types of a roller blind box including a circular tube 2 surrounding the roller blind assembly may be most extensively prefabricated by the manufacturer so that the assembly at the construction site may be performed with a few manual operations. For dispatching, the circular tube at the same time serves the purpose of a packaging for the roller blind assembly.

When a roller blind box in use is defective, it may be built out as a unit even by an unskilled person conveniently and returned to the manufacturer for the purpose of a repair or for an exchange for a new roller blind box.

I claim:

1. A roller blind box adapted to be sealed between the top of the window or a door frame and the opening in the wall and adapted to house a roller blind assembly designed to be rolled down on the exterior of the window or door, comprising:

a one-piece stationary walling, immovable with respect to the window or door frame when in use, in the form of a tube of a circular cross-section having a length substantially equal to the length of the window or door frame on which it is to be mounted and having a passage slit for the roller blind assembly extending throughout the length thereof;

two lateral face walls sealing the ends of said walling so as to prevent penetration of exterior air from the interior of said walling to the interior of the window or door;

a roller blind shaft supported in said two lateral face walls; and gear means for driving the roller blind shaft, whereby exterior air cannot penetrate from the interior of said walling to the interior of the window or door.

2. A roller blind box according to claim 1, wherein the internal diameter of said walling is equal to the external diameter of the roller blind assembly to be housed therein when the roller blind assembly is rolled up closely into a circular roll.

3. A roller blind box according to claim 2, wherein said gearing means acts bidirectionally for driving the roller blind shaft both when rolling and when unrolling the blind.

4. A roller blind box according to claim 1, wherein walling consists of plastic material.

5. A roller blind box according to claim 4, wherein said walling consists of extruded plastic material cut to length.

6. A roller blind box according to claim 1, wherein said walling has retaining flanges or moldings at the outer perimeter thereof for the attachment of covering plates.

7. A roller blind box according to claim 6, wherein said retaining flanges or moldings extend throughout the entire length of said walling.

8. A roller blind box according to one of claims 6 or 7, wherein said flanges or moldings have receiving openings and/or lateral recesses for the insertion of reinforcement sections.

9. A roller blind box according to one of claims 6 or 7, wherein said flanges or molding have receiving openings and/or lateral recesses for the insertion of sound-muffling and/or heat-insulating elements.

* * * * *